United States Patent [19]

Edwards

[11] 4,394,837

[45] Jul. 26, 1983

[54] PASSENGER STATION FOR ELEVATED RAILWAY SYSTEM

[76] Inventor: Lawrence K. Edwards, 3507 Slade Run Dr., Falls Church, Va. 22042

[21] Appl. No.: 257,954

[22] Filed: Apr. 27, 1981

[51] Int. Cl.[3] ..... B61B 1/02; B61B 13/04

[52] U.S. Cl. ..... 104/28; 104/119; 104/121; 104/124; 104/127; 105/144; 105/146; 105/147

[58] Field of Search ..... 104/27, 28, 29, 30, 104/31, 120, 121, 127, 128, 129, 122, 89, 94, 95, 124, 125; 187/8.61, 8.62, 53, 63, 33; 105/141-147, 154-156

[56] References Cited

U.S. PATENT DOCUMENTS

| | | | |
|---|---|---|---|
| 442,279 | 12/1890 | Bardsley et al. | 187/63 |
| 1,246,894 | 11/1917 | Dunn | 187/33 |
| 2,043,356 | 6/1936 | Strauss | 104/28 |
| 3,194,179 | 7/1965 | Scherer | 104/121 |
| 3,890,904 | 6/1975 | Edwards | 104/121 |
| 4,000,702 | 1/1977 | Mackintosh | 104/118 |
| 4,111,130 | 9/1978 | Rodot | 104/28 |

FOREIGN PATENT DOCUMENTS

| | | | |
|---|---|---|---|
| 2348017 | 9/1973 | Fed. Rep. of Germany | 104/28 |

*Primary Examiner*—Bruce H. Stoner, Jr.
*Assistant Examiner*—Donald Hajec
*Attorney, Agent, or Firm*—Senniger, Powers, Leavitt and Roedel

[57] ABSTRACT

In an elevated railway system having a track comprising upper and lower rails extending longitudinally along one side of a beam structure, and passenger cars traveling on the track having doors on their sides adjacent the beam structure, a passenger station comprising an elevator shaft structure, including an elevator car, which extends up from ground level through a gap in the beam structure. A track section with upper and lower rails in continuity with the rails on the beam structure extends alongside the elevator shaft structure at the bottom and top of the door of a car stopped at the station, permitting passenger egress from and ingress to the passenger car and the elevator car between the rails at the station.

19 Claims, 9 Drawing Figures

PASSENGER STATION FOR ELEVATED RAILWAY SYSTEM

BACKGROUND OF THE INVENTION

This invention relates to an elevated railway system of the type comprising a beam with tracks on opposite sides of the beam, and more particularly to a passenger station for an elevated railway system of this type.

This invention is especially concerned with a passenger station for a rapid transit elevated railway system of the type disclosed in my U.S. Pat. No. 3,890,904. In that system, a triangular beam supported above ground level has tracks along both sides of the beam, each track comprising an upper rail and a horizontally displaced lower rail. Cars are adapted to travel on each track alongside the beam, each car having lower wheels which roll on the lower rail and wheeled outriggers extending between the car and the upper rail to support the car upright. The outriggers are movable up and down relative to the car while maintaining the car upright. The car has a door for passenger ingress to and egress from the car on the side of the car adjacent to the track. The triangular beam is hollow; maintenance personnel may travel within it.

SUMMARY OF THE INVENTION

Among the several objects of this invention may be noted the provision of an improved elevated passenger station for an elevated railway system of the type described; the provision of such a station for cars traveling on either side of the station; the provision of such a station which causes minimal blockage of sun and of view; the provision of such a station in which maintenance personnel may readily pass through the station when traveling through the beam; and the provision of such a station particularly suited for elevated railway systems located along the median of a street.

In general, a station of this invention is an adjunct of an elevated railway system of the type comprising a beam structure having a track extending longitudinally along at least one side thereof, the track comprising a lower rail and an upper rail. A car adapted to travel on the track has a door at its side toward the beam structure. The station comprises an elevator shaft structure extending up from ground level generally in the vertical plane of the beam structure in a gap in the beam structure. A track section extends alongside the elevator shaft structure on the same side thereof as the track on the beam structure. The track section has a lower rail and an upper rail in continuity with the lower and upper rails of the beam structure, the lower and upper rails of the track section extending at the bottom and top of the door of a car stopped at the station. This permits passenger egress from and ingress to the elevator shaft structure between the rails. A passenger elevator is movable up and down in the elevator shaft structure for carrying passenger from ground level up to car door level and back.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
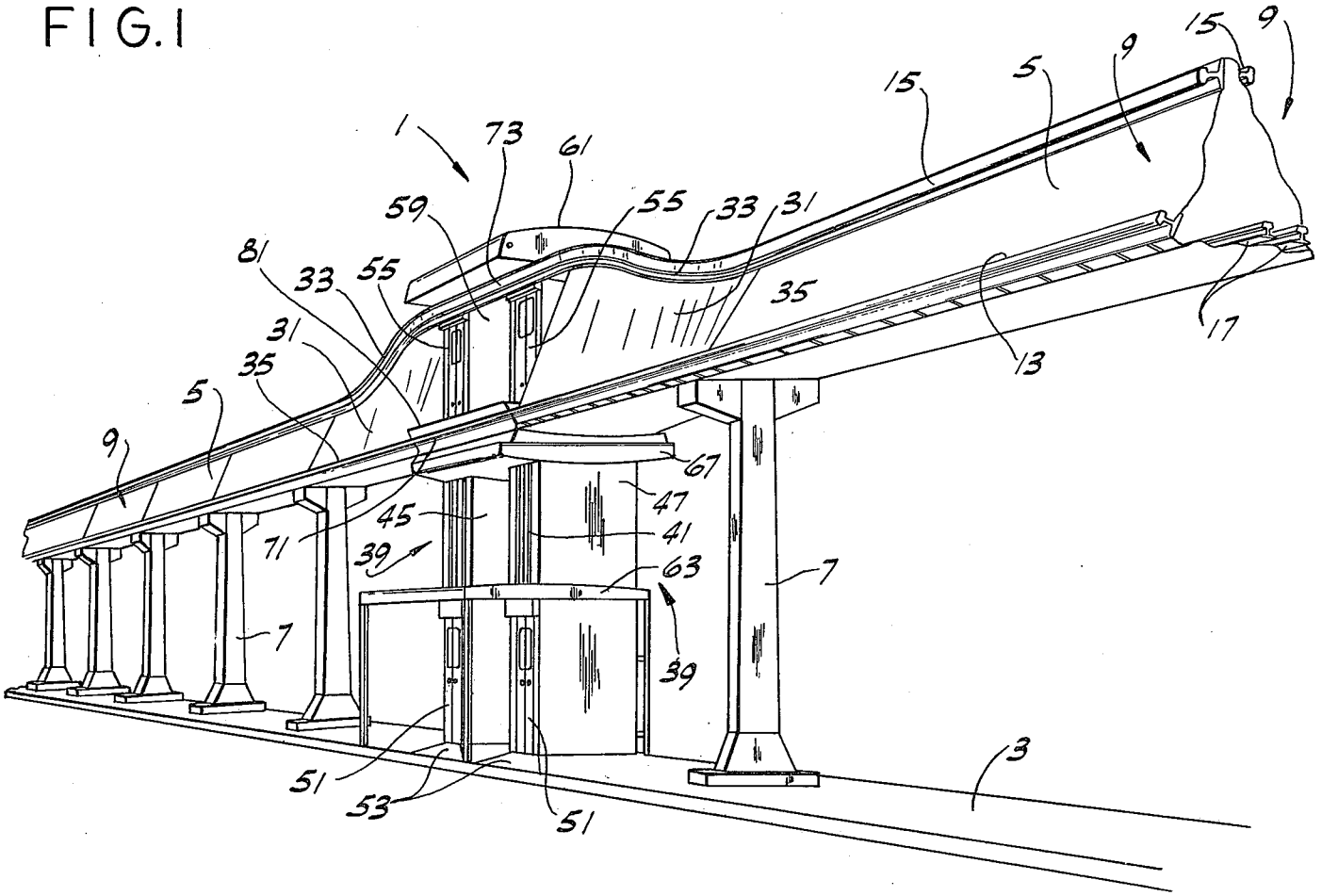
FIG. 1 is a perspective showing a passenger station of this invention.
Figure 4:
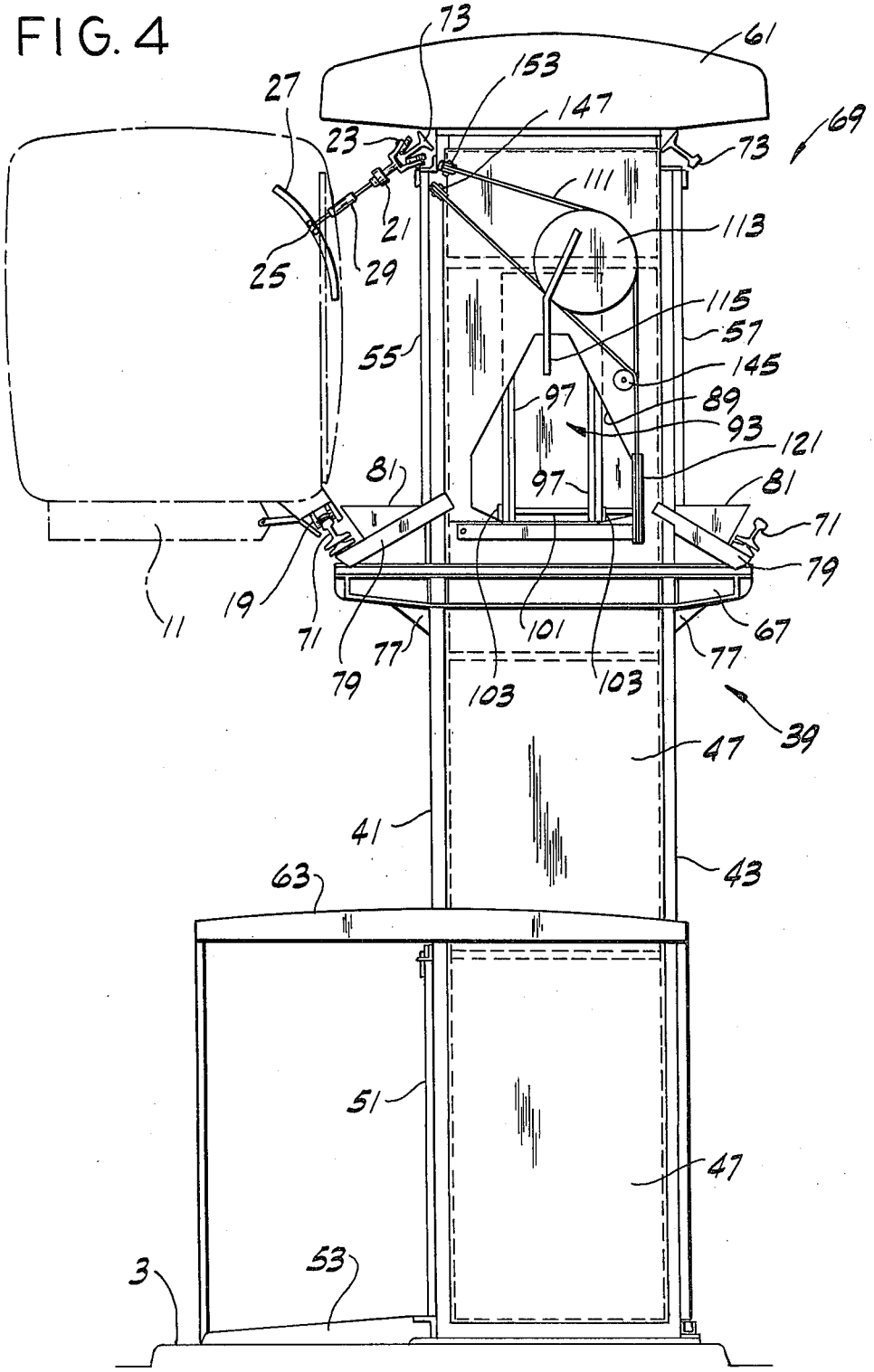
FIG. 4 is a right end elevation of the station of FIG. 1 shown with the elevated railway beam omitted and a car stopped alongside the station.

Referring to the drawings, a passenger station of this invention, designated in its entirety by the numeral 1, is shown in FIG. 1 located on a relatively narrow median 3 of a street along the route of an elevated railway system. The latter is constituted by a beam structure comprising a hollow triangular main beam 5 supported above the median 3 on columns 7. The beam has tracks, generally designated 9, along both sides for travel of passenger cars 11 alongside the beam, as shown in FIG. 4. Each track comprises a lower rail 13 at a lower corner of the triangular beam lying in an outwardly and upwardly extending plane and an upper rail 15 at the upper corner of the same side of the beam as the lower rail. U.S. Pat. No. 3,890,904 may be referred to for further details.

Signal wires and other equipment, such as drive/lock mechanisms and electrical sensors for switches, are located within the triangular beam. For convenient movement of maintenance personnel and equipment, a narrow gauge track 17 is provided within the beam on the floor of the beam. Workmen can move through the beam on low-slung, self-propelled carts (not shown) which travel on track 17. This allows the workmen to work and travel within the beam without interfering with the travel of cars along the outside of the beam.

The passenger cars 11 which travel along the beam may be coupled together to form trains. Each car has a door near its center for passenger boarding and deboarding on its side adjacent the beam. As shown in FIG. 4, the car has slanting double-flanged wheels 19 on its lower side adjacent the beam to engage the lower rail, carrying most of the weight of the car and performing the driving and braking functions. To prevent the car from falling way from the beam, outriggers 21 above the lower wheels link the car to the upper rail. The outriggers have rollers 23 at their outer ends which engage the tracking surfaces of the upper rail. At its inner end each outrigger is mounted on a carriage 25 adapted to roll up and down in an arcuate channel track 27. For further detail see U.S. Pat. No. 3,890,904.

Figure 3:
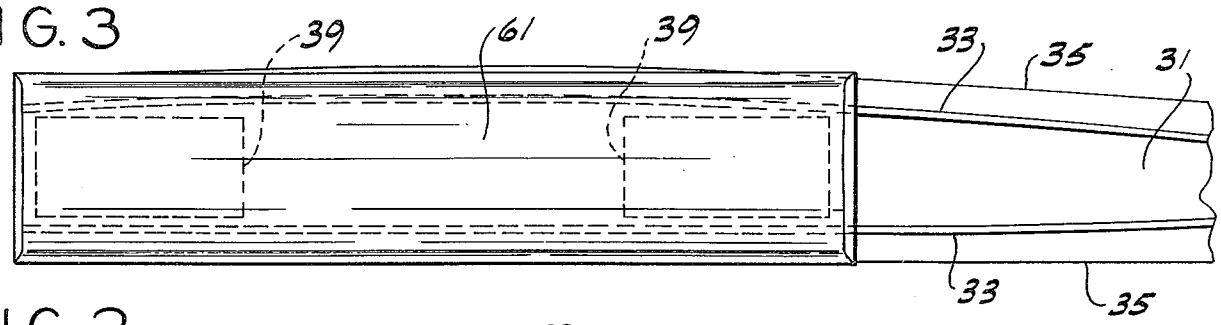
FIG. 3 is a plan of the station.
Figure 2:
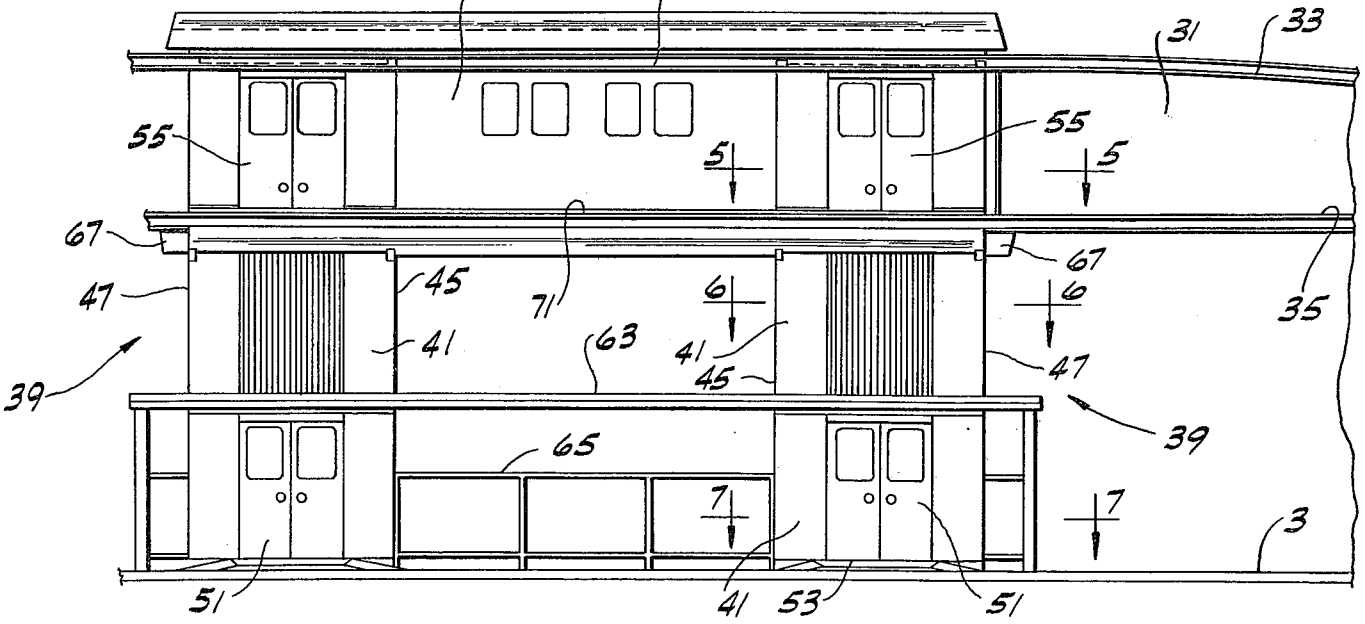
FIG. 2 is a view in elevation of FIG. 1 from one side, which may be designated the front.

As shown in FIGS. 1-3, transition beam sections 31 are provided in the beam structure in conjunction with the main beam 5 to spread the tracks to pass on opposite sides of a dual elevator shaft structure at the station and vertically to spread the upper and lower rails of each track at the station so that the upper rail is spaced above the lower rail at the station a distance such as to enable passenger ingress to and egress from the passenger car 11 between the rails. Each transition beam section has upper rails 33 and lower rails 35 which are in continuity with the rails of the main beam 5. At its end where it joins the main beam, each transition section is of the same triangular cross section as the beam, but elsewhere along its length it has a trapezoidal cross-section. The base and top of each transition section broaden progressively toward the station with the width of the top increasing more than the base. The transition section also increases in height along its length toward the station. Thus, since the upper and lower rails lie along the upper and lower margins of the two sides of the transition section, from each end of the transition section toward the station the lower rail is displaced somewhat outward and the upper rail is displaced upward and substantially outward so that at the station the upper rail is spaced slightly inwardly from the vertical plane of the lower rail and spaced vertically above the horizontal plane of the lower rail a distance (e.g. seven feet) sufficient for passengers to walk in and out of a car between the rails. The lower rail continues at the same level as on the main beam structure. When a car 11 enters and travels on the transition section, its outrigger carriages 25 roll upward in tracks 27 and maintain the car level. Maintenance car tracks 37 (see FIG. 5) are provided within each transition section in continuity with tracks 17 in the regular beam structure.

Station 1 comprises two elevator shaft sections, as shown in FIG. 2, each generally designated 39, which extend up from median 3 (ground level) generally in the vertical plane of the beam structure in a gap in the beam structure between the ends of the two transition beam sections 31 at the station. The two elevator shaft sections are spaced apart longitudinally with respect to the route of the railway system, the centerlines of the two shaft sections being spaced apart the same distance as the doors of two passenger cars 11 coupled together. As appears in FIGS. 1 and 4, both sections are offset relative to the centerline of the median to the same side of the median (its right side as viewed in FIG. 4). The elevator shafts are primarily constructed of suitable conventional structural steel members, each having a front wall 41, rear wall 43, inner end wall 45, outer end wall 47 and bottom 49. At ground level each shaft has elevator-type sliding door means 51 (comprising two sliding panels) at the front, i.e. on the side of the shaft nearest the centerline of the median, thus providing ample space for a walkway 53 on the median for entering and leaving an elevator car in the shaft. Spaced above ground level at the level of a car stopped at the station, as described below, each elevator shaft has elevator-type sliding door means 55 in the front wall 41 of the shaft and a similar sliding door means 57 in the rear wall 43 of the shaft.

Between the two elevator shaft sections 39 at the level of upper doors 55 and 57 is an enclosed bridge structure 59, which may serve as a utility room. A roof 61 extends over the two elevator shafts and the structure 59 between them. An awning 63 may be provided above the ground level door mean 51 and extends between the two elevator shafts 39. A guard rail 65 is provided at ground level between the two shaft sections on their rear sides 43. Transverse beams 67 outward of outer end walls 47 of shafts 39 support the two transition beam sections 31 at the opposite ends of the station.

Track sections, generally designated 69, extend alongside the elevator shaft sections at both the front and rear sides of the station. Each track section comprises a lower rail 71 substantially at the level of the floor of the bridge structure 59 lying in a plane extending outwardly and upwardly therefrom, and an upper rail 73 below roof 61 lying in a plane extending outwardly and downwardly. These rails are in continuity with the lower rails 35 and upper rails 33 of the transition beam sections 31. Lower rails 71 are below the bottoms of elevator shaft doors 55 and 57 and upper rails 73 are above the tops of the doors. The rails are thereby at the bottom and top of the door of a car 11 stopped at the station, allowing easy passenger ingress to and egress from the elevator shaft between the rails. Lower rails 71 are supported alongside and spaced outward of elevator shaft structures 39 and bridge structure 59 by a plurality of transverse beams 75 (see FIG. 5) and lower struts 77 and upper struts 79 (FIG. 4). Upper struts 79 also support decks or platforms 81 outward of elevator shaft upper doors 55 and 57 for passengers walking between the elevator car in an elevator shaft and the railway car. Upper rails 73 are supported by front and rear walls 41 and 43 at their intersections with roof 61.

Figure 6:
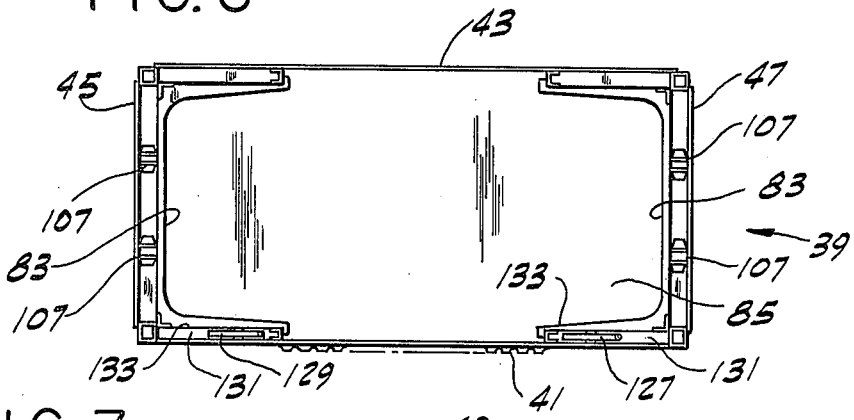
FIG. 6 is a horizontal section on line 6—6 of FIG. 2 showing the elevator car.
Figure 8:
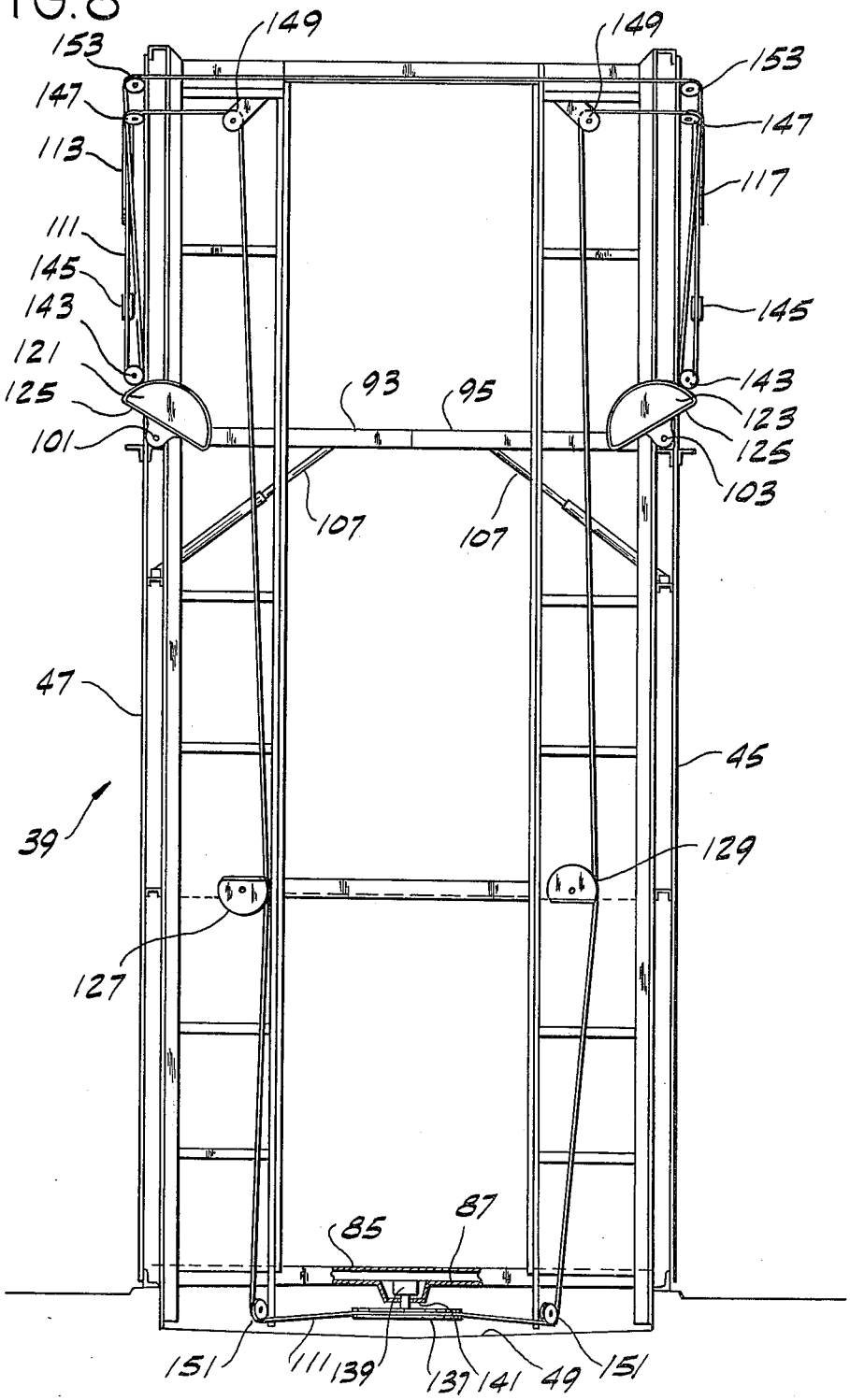
FIG. 8 is a vertical section on line 8—8 of FIG. 5 showing the elevator shaft, a portion of the elevator car bottom being shown at the bottom of the shaft, and an interior panel being omitted to reveal a pulley and cable system for raising and lowering the bridge sections and locking the elevator car at the bottom of the elevator shaft.

Each elevator shaft has a passenger elevator car 83 movable up and down therein for carrying passengers from ground level up to a car door and back, shown in plan in FIG. 6. The car is raised and lowered by conventional elevator equipment which may be housed in 61, with suitable conventional controls. The floor 85 and subfloor 87 of the car are shown in FIG. 8.

Figure 5:
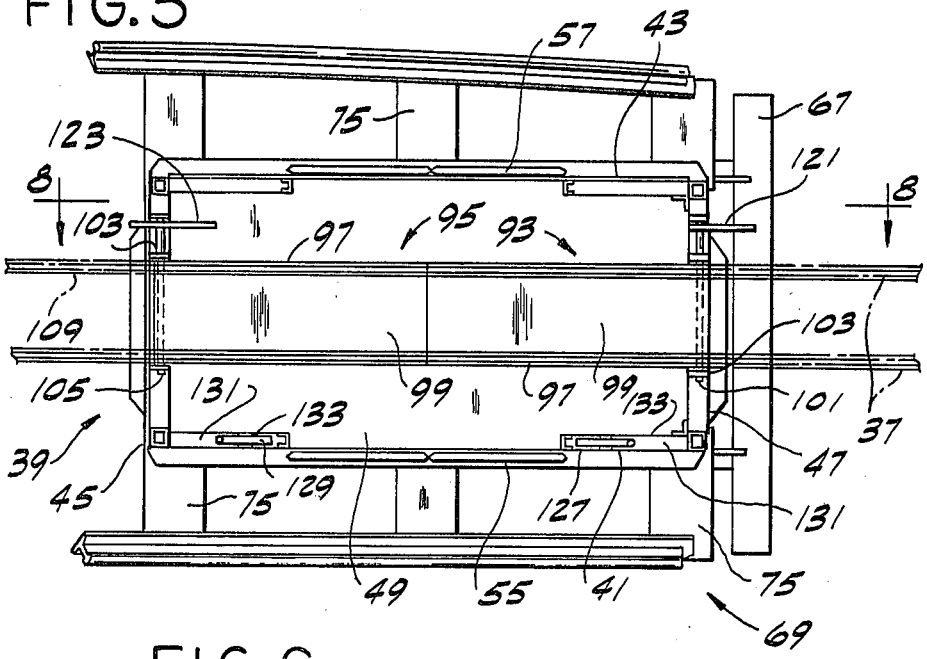
FIG. 5 is a horizontal section on line 5—5 of FIG. 2 showing an elevator shaft omitting the elevator car therein, and showing bridge sections lowered to enable a maintenance car to travel through the shaft.
Figure 9:
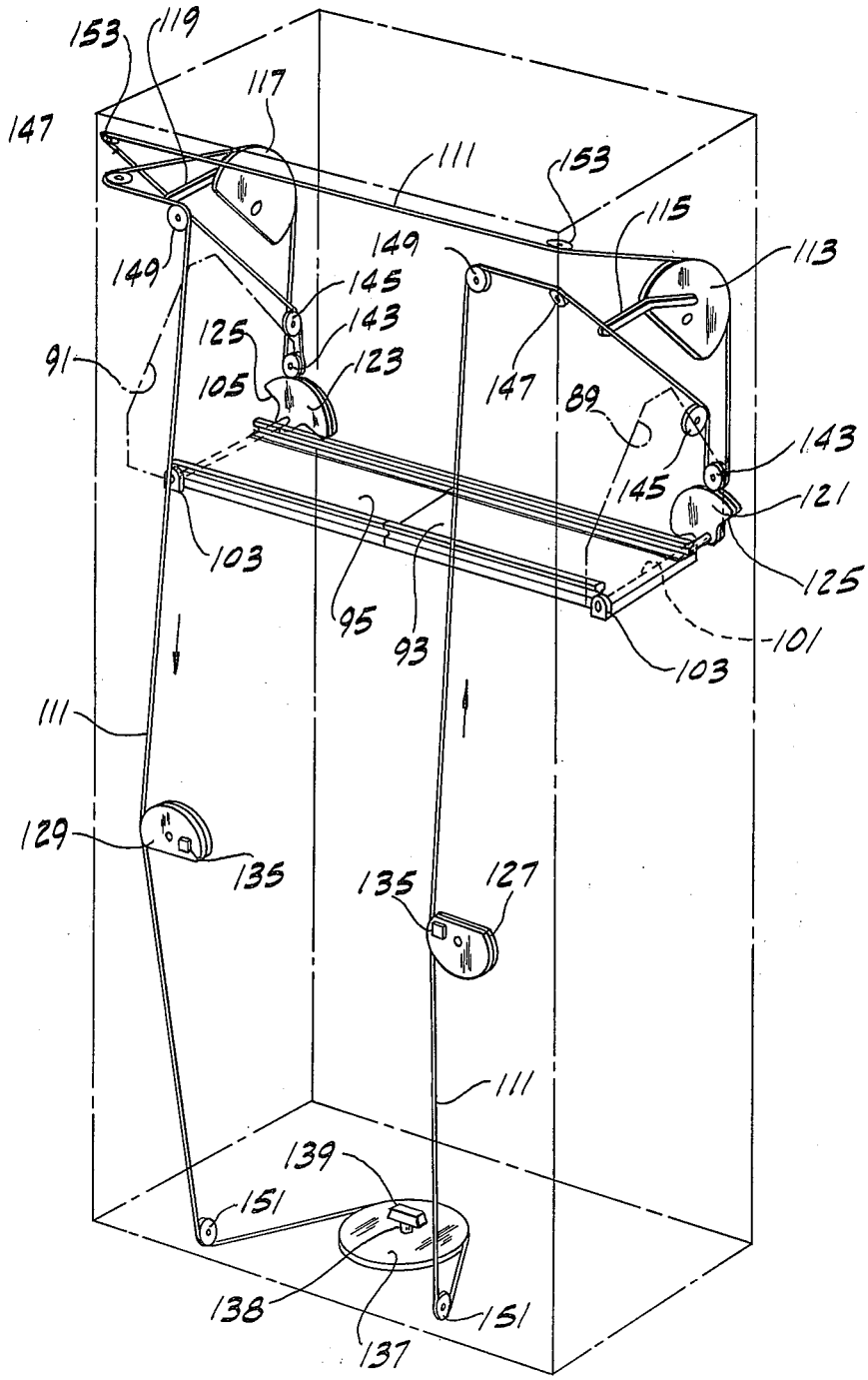
FIG. 9 is a diagram illustrating the cable and pulley system.

As illustrated in FIGS. 5 and 9, each elevator shaft has relatively large openings or doorways in its end walls for workmen to pass into the elevator shaft, one doorway 89 in the outside end wall 47 leading to the interior of transition beam section 31 and another doorway 91 in the inside end wall 45 leading into the enclosed bridge structure 59. So that the maintenance cars can pass through the elevator shaft, a drawbridge-like structure formed of two pivoted bridge sections 93 and 95 is provided, each comprising rails 97 mounted on a plate 99. Bridge section 93 is hinged at the outside end wall 47 of the shaft adjacent transition beam section 31 inward of doorway 89, being fixed to a shaft 101 rotatable in bearings 103. The other bridge section 95 is hinged at the inside end wall 45 of the shaft adjacent the storage area inward of doorway 91, similarly fixed to a shaft 105. When the two bridge sections are pivoted up to a vertical or retracted position, clearance is provided for the elevator car to ascend between them. When the two bridge sections are pivoted down to a horizontal position, as shown in FIG. 8, they meet at the center of the elevator shaft to provide a track through the elevator shaft continuous with tracks 17 and 37. Telescoping supports 107 beneath the tracks connected to the end walls of the elevator shaft support the bridge sections while in the down position. Maintenance car rails 109, indicated in phantom in FIG. 5, extend through bridge structure 59 to permit the maintenance cars to continue through the station.

A system of pulleys and a continuous or endless cable 111, shown schematically in its entirety in FIG. 9, serves as means to permit manual raising and lowering of bridge sections 93 and 95, to lock the elevator car 83 at ground level, and to lock ground level door 51 closed when the bridge sections are lowered. The system shown in FIG. 9 is for the right-hand elevator shaft viewed from the front of the station. Some parts may be reversed for the other shaft. This system includes a first part-circular pulley 113, having an arcuate edge extending approximately 225° and a chordal edge, mounted for rotation on the outside of end wall 47 of the elevator shaft parallel to the wall above opening 89 from the elevator shaft into transition beam section 31. A lever 115 for manually rotating pulley 113 is fixed thereto extending outward generally parallel to its chordal edge. A similar pulley 117 having a lever 119 is rotatably mounted on the outer side of inner end wall 45 of the shaft inside room area 59 above opening 91.

Another part-circular pulley segment 121, having an arcuate edge extending approximately 150° and a chordal edge, is mounted on the rear end of shaft 101 for bridge section 93. Segment 121, which rotates with the bridge section, lies in a plane parallel to the front and rear walls of the elevator shaft. A pulley 123 corresponding to 121 is fixed to the rear end of shaft 105 of bridge section 95. As shown in FIGS. 8 and 9, the chordal edges 125 of these two pulleys face downwardly and outwardly when the bridge sections are in their down (horizontal) positions.

Figure 7:
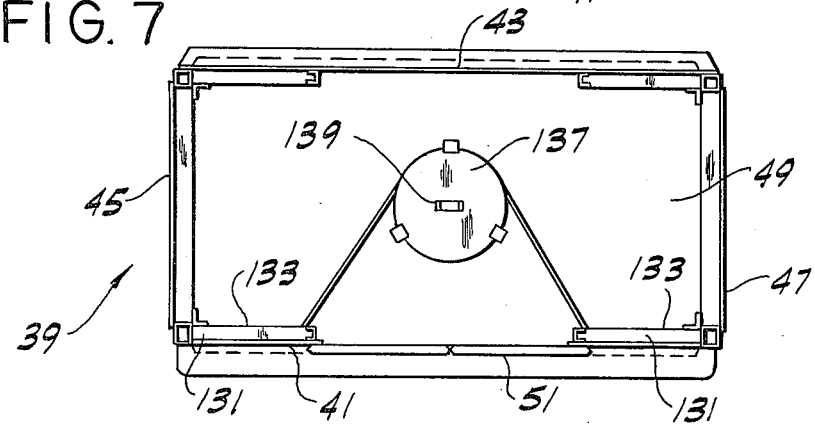
FIG. 7 is a horizontal section on line 7—7 of FIG. 2 with the elevator car omitted.

Two circular pulleys 127 and 129 are mounted by means of horizontal shafts for rotation on the inside of front wall 41 of the elevator shaft immediately outward of the outer upper corner of each sliding panel of ground level door 51 (with the door closed). As shown in FIGS. 5–7, spaces 131 are provided on the inside of the front wall 41 by interior panels 133 extending from the top to the bottom of the elevator shaft. Pulleys 127 and 129 are accommodated in these spaces. Each of these two pulleys has an eccentric lug 135 on its front side projecting outward of front wall 41, the arrangement being such that on rotation of pulleys 127 and 129 in one direction, the lugs rotate to a locking position in which they lock the door panels closed, and on rotation of the pulleys in the opposite direction, the lugs rotate to a retracted position to permit the panels to open.

As shown in FIG. 9, a pulley 137 is mounted on a vertical shaft 138 at the center of the bottom 49 of the elevator shaft. This shaft has a latch member 139 on its upper end adapted for reception in a latch slot 141 in the subfloor 87 of the elevator car when the car descends to the bottom of the elevator shaft. The latch member 139 is rotatable between a release position wherein it is aligned with the slot and a latching position crosswise of the slot for locking down the car in its down (ground level) position.

The endless cable 111 is trained around the above-described pulley and suitable intermediate guide pulleys extending around pulley 113 and downard therefrom where it is trained around the lower side of one pulley of a double-pulley cluster 143, positioned immediately above pulley 121, from which the cable is trained completely around pulley 121 and below the other pulley of the double-pulley cluster 143. From this point the cable extends upward along end wall 47 to and around a guide pulley 145 and upward and forward along end wall 47 to another guide pulley 147 near the front wall 41 of the shaft. From pulley 147 the cable extends horizontally along front wall 41 to another guide pulley 149, from which it extends down adjacent the front wall behind interior panel 133 within space 131 to the pulley 127. The cable is trained around pulley 127 and continues down in space 131 to a guide pulley 151 near ground level which directs it toward pulley 137. It passes around the rear of pulley 137 and is thence directed on the other side of the elevator shaft by a similar series of pulleys, which are correspondingly labelled with one dissimilarity: in extending upward along the front wall of the elevator shaft, the cable leads to the outer, rather than inner, edge of pulley 129, that is, the edge adjacent end wall 45. Across the top of the elevator shaft, the cable leads from pulley 113 to pulley 117 via two guide pulleys 153 at the upper front corners of the elevator shaft.

In setting up the cable and pulley system, the positions of the various pulleys are coordinated (phased) as shown in FIG. 9, so that lever arms 115 and 119 of pulleys 113 and 117 extending generally horizontally, bridge sections 93 and 95 are horizontal, lugs 135 are down to lock elevator doors 51 closed, and latch 139 is in its latching position in opening 141 in the elevator car subfloor 87 locking the car in its down position.

On pivoting one or the other of the lever arms 115 or 119 down to a vertical position, pulleys 113 and 117 are rotated generally one-quarter turn, which rotates pulleys 121 and 123 to pivot bridge sections 93 and 95 upward to their vertical (retracted) position. Pulleys 127 and 129 rotate to move lugs 135 upward out of engagement with the panels of ground level elevator door 51, and pulley 137 rotates latch 139 to its release position relative to in opening 141 in elevator car subfloor 87 to unlock the latch from the subfloor. This permits the ground level door 51 to open and the car to ascend in the elevator shaft between the bridge sections. In this state of the cable-pulley system, lever arms 115 and 119 partially block openings 89 and 91, indicating to workmen that the bridge sections are raised, this being the normal state of the system. The bridge sections are lowered only for short periods of time when workmen wish to pass through the elevator shaft.

A principal advantage of the passenger station described above is its ability to service railway cars traveling in either direction, that is, on either side of the station. The station is particularly suited for placement on a street median. It causes only minimal blockage of sun and view, a principal consideration in the design of elevated railway systems. And it incorporates a simple, rugged, and convenient mechanism for permitting workmen to pass through the station while traveling along in the elevated beam.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. In an elevated railway system comprising a beam structure, a track extending longitudinally of the beam structure along one side thereof, the track comprising a lower rail and an upper rail, and a car adapted to travel on the track having a door in its side toward the beam structure: a station comprising an elevator shaft structure extending up from ground level generally in the vertical plane of the beam structure in a gap in the beam structure, the gap in the beam structure being between first and second transition beam sections, the transition beam sections being effective to spread the upper and lower rail of the track, a track section extending alongside the transition beam sections on the same side thereof as the track on the beam structure and comprising a lower rail and an upper rail in continuity with the lower and upper rails of the beam structure, a track section extending alongside the elevator shaft structure on the same side thereof as the track on the beam structure and comprising a lower rail and an upper rail in continuity with the lower and upper rails of the first and second transition beam sections, the lower and upper rails of said track section extending to the bottom and top of the door of a car stopped at the station for passenger egress from and ingress to the elevator shaft structure between the rails, and a passenger elevator movable up and down in the elevator shaft structure for carrying passengers from ground level up to car door level and back.

2. In an elevated railway system as set forth in claim 1, the elevator shaft structure having a door at ground level and a door at the level of the door of a car stopped at the station.

3. In an elevated railway system as set forth in claim 1, the elevator shaft structure being constructed for passage of service personnel therethrough along the route of the beam structure.

4. In an elevated railway system as set forth in claim 3, the elevator shaft structure having bridge means for bridging the route therethrough when the elevator is down at ground level, the bridge means being movable to a retracted position for clearance for movement of the elevator to the car door level.

5. In an elevated railway system as set forth in claim 4, means for locking the passenger elevator down at ground level when the bridge means is bridging the route through the elevator shaft.

6. In an elevated railway system as set forth in claim 4 in which maintenance vehicle tracks are provided along the route of the beam structure, the bridge means having tracks for the maintenance vehicle, the tracks on the bridge means being movable with the bridge means for clearance of the passenger elevator traveling in the elevator shaft.

7. In an elevated railway system as set forth in claim 1, the first transition beam section having gradually increasing vertical spacing of the upper rail from the lower rail along its length toward the station and the second transition beam section having gradually decreasing vertical spacing of the upper rail from the lower rail along its length away from the station, the upper rail of the transition beam sections being higher than the upper rail of the beam structure, the lower rail of the transition beam sections being level with the lower rail of the beam structure.

8. In an elevated railway system as set forth in claim 1, the upper rail of the track section at the station being displaced upward and substantially outward while the lower rail of the track section at the station is displaced slightly outward relative to the rails of the beam structure, said upper rail of the track section at the station being slightly inward from the vertical plane of the lower rail of the track section at the station and spaced vertically above the horizontal plane of said lower rail a distance sufficient for passengers to walk in and out of a car between rails.

9. In an elevated railway system comprising a beam structure, tracks extending longitudinally of the beam structure along both sides thereof, each track comprising a lower rail and an upper rail, and cars adapted to travel on the tracks, each having a door in its side toward the beam structure: a station comprising an elevator shaft structure extending up from the groun level generally in the vertical plane of the beam structure in a gap in the beam structure, said elevator shaft structure comprising two elevator shafts spaced longitudinally with respect to the route of the system, the gap in the beam structure being between first and second transition beam sections, the transition beam sections being effective to spread the upper and lower rails of each track, a track section extending alongside the transition beam sections on both sides thereof each comprising a lower rail and an upper rail in continuity with the lower and upper rails of the respective track on the beam structure, track sections extending alongside the elevator shaft structure on both sides thereof each comprising a lower rail and an upper rail in continuity with the lower and upper rails of the respective track on the first and second transition beam sections, the lower and upper rails of each said track section extending at the bottom and top of the door of a car stopped at the station for passenger ingress to and egress from an elevator shaft between the rails, and a passenger elevator movable up and down in each elevator shaft section for carrying passengers from ground level up to a car door and back.

10. In an elevated railway system as set forth in claim 9, each elevator shaft having a door at ground level and doors at opposite sides of the station at the level of the door of a car stopped at the station.

11. In an elevated railway system as set forth in claim 10, the elevator shaft doors at the level of a car stopped at the station being between the upper and lower rails of the respective track sections.

12. In an elevated railway system as set forth in claim 11 wherein the elevator shafts extend up from the median of a street and are spaced apart along the median.

13. In an elevated railway system as set forth in claim 12 wherein each of the elevator shafts is displaced laterally relative to the center of the median toward the same side of the median, the door at ground level of each elevator shaft being on its side nearer the center of the median.

14. In an elevated railway system as set forth in claim 11, an enclosed structure bridging the elevator shafts carrying the tracks at opposite sides thereof, each elevator shaft having doorways for passage of service personnel along the route through the elevator shafts and said enclosed structure.

15. In an elevated railway system as set forth in claim 14, each elevator shaft having bridge means for bridging the route therethrough when the elevator is down at ground level, the bridge means being movable to a retracted position for clearance for movement of the elevator to the car door level.

16. In an elevated railway system as set forth in claim 15, means for locking each passenger elevator down at ground level when the respective bridge means is bridging the route therethrough.

17. In an elevated railway system as set forth in claim 16 in which maintenance vehicle tracks are provided along the route of the system, comprising tracks through said enclosed structure and tracks on the bridge means, the tracks on the bridge means being movable with the bridge means for clearance of the passenger elevator traveling in the elevator shaft.

18. In an elevated railway system as set forth in claim 9, the first transition beam section having gradually increasing vertical spacing of the upper rails from the lower rails along its length toward the station and the second transition beam section having gradually decreasing vertical spacing of the upper rail from the lower rail along its length away from the station, the upper rails of the transition beam sections being higher than the upper rails of the beam structure while the lower rails of the transition beam sections are level with the lower rails of the beam structure.

19. In an elevated railway system as set forth in claim 9, the upper rails of the track section at the station being displaced upward and substantially outward while the lower rails of the track section at the station are displaced slightly outward relative to the rails of the beam structure, said upper rails of the track section at the station being slightly inward from the vertical plane of the lower rails of the track section at the station and spaced vertically above the horizontal plane of said lower rails a distance sufficient for passengers to walk in and out of a car between rails.

* * * * *